US005400450A

United States Patent [19]

Leoutsakos

[11] Patent Number: 5,400,450

[45] **Date of Patent: * Mar. 28, 1995**

[54] MANUAL SUPPORT APPARATUS

[76] Inventor: Thomas Leoutsakos, 19 Layfayette St., Randolph, Mass. 02368

[ * ] Notice: The portion of the term of this patent subsequent to Mar. 23, 2010 has been disclaimed.

[21] Appl. No.: 84,540

[22] Filed: Jun. 28, 1993

Related U.S. Application Data

[63] Continuation-in-part of Ser. No. 984,860, Dec. 3, 1992, Pat. No. 5,257,426, which is a continuation of Ser. No. 869,956, Apr. 17, 1992, Pat. No. 5,195,299.

[51] Int. Cl.[6] ..... A47C 20/02

[52] U.S. Cl. ..... 5/662; 5/426; 5/503.1

[58] Field of Search ..... 5/425, 426, 428, 503.1, 5/658, 662

[56] References Cited

U.S. PATENT DOCUMENTS

| | | | |
|---|---|---|---|
| 1,797,847 | 3/1931 | Vandagriff | 5/507.1 X |
| 2,555,228 | 5/1951 | Evers | 5/426 |
| 2,593,567 | 9/1952 | Keck | 5/503.1 X |
| 2,712,137 | 7/1955 | Hunter | 5/425 X |
| 2,722,693 | 11/1955 | Wolf | 5/426 |
| 2,751,608 | 6/1956 | Lucas | 5/426 |
| 2,929,078 | 3/1960 | Smith et al. | 5/428 |
| 3,474,473 | 10/1969 | Hannaberg | 5/426 |
| 3,863,282 | 2/1975 | Stillwell | 5/503.1 |
| 4,104,751 | 8/1978 | Churchman | 5/503.1 |
| 4,334,330 | 6/1982 | Marshall | 5/662 X |
| 4,561,549 | 12/1985 | Yokohori | 5/658 X |
| 4,836,523 | 6/1989 | Englander | 5/662 X |
| 4,932,090 | 6/1990 | Johnasson | 5/662 |
| 5,121,516 | 6/1992 | Jones | 5/658 |
| 5,195,200 | 3/1993 | Leoutsakos | 5/503.1 |
| 5,231,721 | 8/1993 | Fish | 5/503.1 X |

FOREIGN PATENT DOCUMENTS

| | | | |
|---|---|---|---|
| 2500743 | 9/1982 | France | 5/445 |
| 1006956 | 10/1965 | United Kingdom | 5/425 |
| WO82/02832 | 9/1982 | WIPO | 5/445 |

*Primary Examiner*—Michael F. Trettel
*Attorney, Agent, or Firm*—Wolf, Greenfield & Sacks

[57] ABSTRACT

A manual support apparatus for use with a bed having a mattress portion for providing a secure and stable method for a user/patient to transfer into and out of bed independently, and enhance in-bed mobility. The manual support apparatus has three primary parts: a planar plate member, a support tube having at least one leg and at least one tubular member. The tubular member has an internal bore for slidable receipt of the support tube leg, and is attached to the plate member by suitable means. The plate member is placed under the bed's mattress portion such that the tubular member is adjacent and substantially perpendicular to the mattress.

In another embodiment, the manual support apparatus includes a planar plate member and at least one support tube attached directly to the plate member. Alternatively, the manual support apparatus can have a unitary construction, including a planar plate portion and at least one support tube portion.

6 Claims, 6 Drawing Sheets

MANUAL SUPPORT APPARATUS

This application is a continuation-in-part of U.S. application Ser. No. 07/984,860, filed Dec. 3, 1992, now U.S. Pat. No. 5,257,426, which is a continuation of U.S. application Ser. No. 07/869,956, filed Apr. 17, 1992, now U.S. Pat. No. 5,195,299.

BACKGROUND OF THE INVENTION

1. Field of the Invention

The present invention pertains to a manual support apparatus and, more particularly, to a manual support apparatus to assist user's in transferring into and out of bed, as well as with in-bed mobility.

2. Description of the Prior Art

Transferring into and out of bed, as well as maneuvering in bed, may be a difficult process for some elderly or disabled persons.

Typical beds provide little or no additional manual support to assist people to gain their balance while transferring into or out of bed, or help them to adjust their in-bed posture. Particularly at risk of falling, are acute or chronic term patients, in the home environment, which require assistance maneuvering into and about a bed. These patients generally require a secure and stable method to transfer into and out of bed independently. A wheelchair user, for example, may find it difficult to transfer into and out of bed without assistance. It would be useful, therefore, to provide an apparatus for manual support.

While various home care and hospital beds have been available in the prior art, these beds are generally expensive. In addition, these beds generally provide only full side rails which are raised to prevent patients from falling out of bed. These side rails do not assist the user in transferring into or out of bed. Furthermore, a patient may require additional support for only a temporary period and, therefore, would not require a new bed if an existing bed can be modified.

It is therefore an object of this invention to provide an apparatus attachable to a bed which provides a secure and stable method to transfer into and out of bed independently, and improve in-bed mobility. A further object of the invention is to provide a manual support apparatus, which can be easily assembled and disassembled, as well as quickly installed on any side of a bed.

SUMMARY OF THE INVENTION

According to the present invention, a manual support apparatus includes three primary parts: a planar plate member, a support tube having at least one leg and at least one tubular member. The tubular member has an internal bore for slidable receipt of the support tube leg, and is attached to the plate member by suitable means. The plate member is placed under the bed's mattress portion such that the tubular member is adjacent and substantially perpendicular to the mattress.

In another embodiment of the present invention, the manual support apparatus includes a planar plate member and a support tube having at least one leg, which is attached directly to the plate member. The plate member is then placed under the bed's mattress portion such that the support tube is adjacent and substantially perpendicular to the mattress.

In an alternative embodiment, the manual support apparatus is one-piece, including a planar plate portion and a support tube portion having at least one leg. The plate portion is then placed under the bed's mattress portion such that the support tube portion is adjacent and substantially perpendicular to the mattress.

Other objects and features of the present invention will become apparent from the following detailed description, when taken in connection with the accompanying drawings which disclose a preferred embodiment of the invention. It is to be understood that the drawings are designed for the purpose of illustration only and are not intended as a definition of the limits of the invention.

BRIEF DESCRIPTION OF THE DRAWINGS

The foregoing and other objects and advantages of the invention will be appreciated more fully from the following drawings in which.

DETAILED DESCRIPTION OF THE INVENTION

Figure 1:
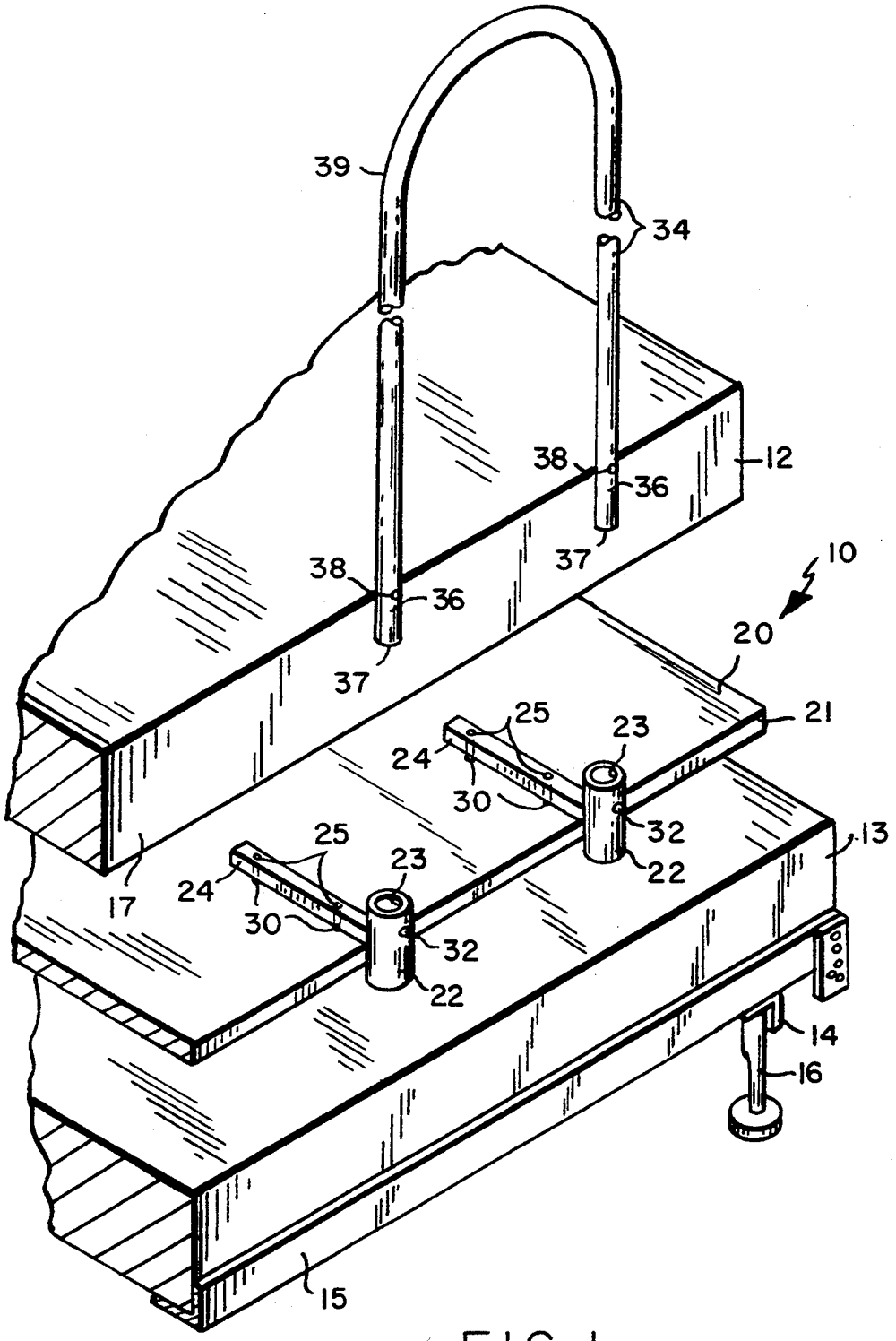
FIG. 1 a perspective view of one embodiment of the present invention disassembled.

Turning now to the Figures, wherein like reference numerals indicate like elements, FIG. 1 illustrates one embodiment of the manual support apparatus of the present invention. The manual support apparatus 10 may be easily installed on a typical bed, having a mattress 12 and boxspring 13 resting upon a bedframe 14. Typically, bedframe 14 is rectangular in shape and consists of end and side rails 15 connected at four corners. However, it is to be understood by those skilled in the art that any bed consisting of a boxspring 13, or foundation, with a mattress 12 thereon can utilize the manual support apparatus 10 of the present invention. A leg 16 or wheel (not shown) is positioned beneath each corner in support of bedframe 14. The manual support apparatus 10 comprises a planar plate member 20 having an outside edge 21, and at least one tubular member 22 having an internal bore 23 for slidable receipt of a support tube 34 having at least one leg 36.

FIG. 1 shows two tubular members 22 attached to support braces 24 having two holes 25 which allow braces 24 to be attached to plate 20 with screws, bolts, or the like. Support tube 34 is shown above tubular members 22 with legs 36 positioned over bores 23.

After support braces 24 are attached to plate member 20, by means known to those skilled in the art, plate member 20 is placed under mattress 12 such that tubular members 22 are adjacent to a side 17 of, and substantially perpendicular to mattress 12 and boxspring 13.

Planar plate 20 is typically made from a lightweight, rigid material such as plastic, fiberglass, wood or metal. Preferably, planar plate 20 is constructed of a plastic material such as high density polyethylene or polyvinylchloride; more preferably, planar plate 20 is made from a composite wood material, such as standard plywood, due to its light weight, strength and relatively inexpensive price. Most preferably, planar plate 20 is made from a metal material, such as stainless steel or aluminum, due to its strength and workability. Planar plate 20 is typically shaped such that at least one edge 21 is aligned with a side 17 of mattress 12 and boxspring 13. It is noted that planar plate 20 may be any shape to support tubular members 22. Preferably, planar plate 20 is shaped such that an outside edge 21 aligns with a side 17 of mattress 12 and boxspring 13. Furthermore, planar plate 20 should be relatively long and thin, in a manner providing that in installation it may be slipped under mattress 12 without significantly raising the mattress and long enough so as to be firmly held in place by the mattress without easily being dislodged. In addition to securing tubular members 22 (and support tube 34), planar plate 20 provides additional mattress support and, therefore, additional comfort when the user/patient is in a reclined position.

Tubular members 22 are typically made from a rigid, durable material such as a hard plastic or metal. Preferably, tubular members 22 are made from steel pipe; more preferably, tubular members 22 are made from aluminum pipe due to its light weight. Tubular members 22 have a central aperture, or bore 23, with a tubular axis. Tubular members 22 and support tube have complimentary cross-sectional configurations, allowing the support tube legs 36 to be coaxially slidable through bore 23 of tubular member 22. The internal diameter of bore 23, and the outside diameter of the support tube legs 36, is wide enough to provide support and narrow enough to be easily grasped by a user/patient. Typically, the diameters are between about ½ inch to about 3 inches. Preferably, the diameters are between about ¾ to about 1 inch. The legs 36 of support tube 34 may include projections 38 which are spring-fit into, and can be pressed into, support tube legs 36 while the legs are placed into bores 23 of tubular members 22. Projections 38 provide a locking mechanism as they are snap-fit into holes 32.

Tubular members 22 are typically secured to support braces 24 prior to being attached to planar plate 20. Tubular members 22 may be secured to support braces 24 in any manner known to those skilled in the art, including being screw-fit, or snap-fit; preferably, however, tubular members 22 are welded to support braces 24.

Support braces 24 typically includes holes 25 which align with holes 30 on planar plate 20. The holes 25, 30 allow bolts, pins, clips, or any other suitable means (not shown) to attach planar plate 20 to braces 24. In this manner, braces 24, including tubular members 22, may be removably attached from planar plate 20. Alternatively, braces 24 and tubular members 22 may be fixed (for example, welded) to either the top or underside of plate member 20. Another approach involves braces 24 and tubular members 22 being independently removably attached to plate member 20.

Although support tube 34 is shown in a typical inverted U-shape, other shapes, and various sizes, as required by each user/patient can be provided. It is noted that there are many size and/or shape variations of support tubes 34 which can be utilized with manual support apparatus 10. A single support tube 3.4 may be used, for example, as an intravenous fluid holding pole, a trapeze holding pole, or as part of a traction unit. Multiple support tubes 34 may be used in combination, for example, as a food tray or phone table with an inverted U-shaped support tube. It is also noted that manual support apparatus 10 may be attached to any side of a bed, to address any patient's particular needs.

Support tube 34 is typically made from a rigid, durable material such as a hard plastic or metal. Preferably, support tube 34 is made from steel pipe; more preferably, support tube 34 is made from aluminum pipe due to its light weight. Most preferably, support tube 34 is made of a material similar to that of the tubular members 22. Support tube 34 provides assistance to a user/patient to transfer into and out of bed, as well as increasing in-bed mobility and safety. To further aid the user/patient, top portion 39 of support tube 34 may be knurled and/or padded to provide added comfort and a more secure grip.

Figure 2:
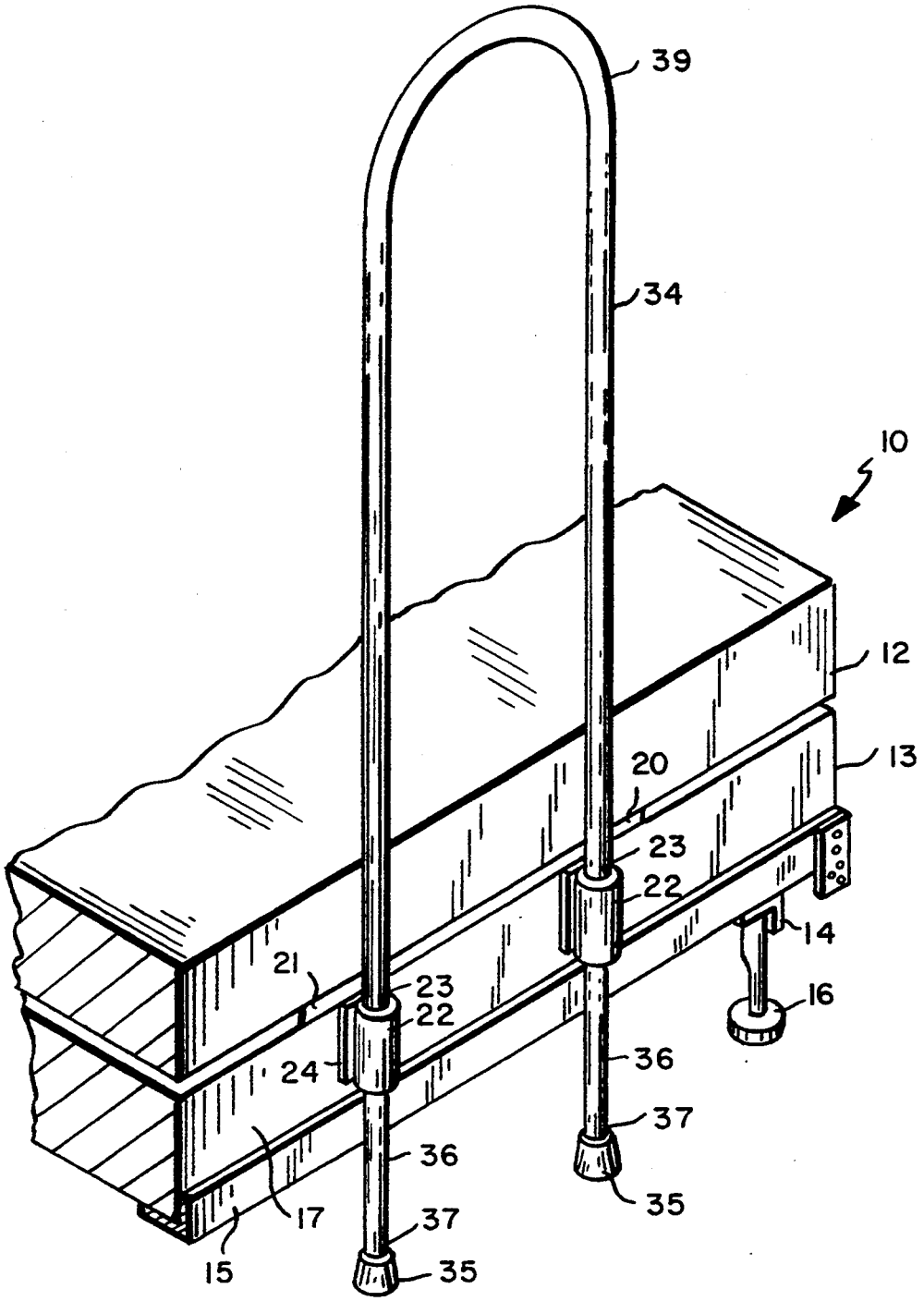
FIG. 2 is a perspective view of another embodiment of the present invention assembled.

FIG. 2 shows an alternative embodiment of manual support apparatus 10, assembled and installed on a bed. Tubular members 22, as described above, are shown attached to opposite ends of an alternative support brace 24'. Support brace 24' is attached to plate 20 as described above. Furthermore, in this embodiment, projections 38 and holes 32 are omitted from legs 36 and tubular members 22. In operation, once legs 36 of support tube 34 pass through bores 23 of tubular members 22, ends 37 are covered with caps 35. Caps 35 are typically made from a rubber-like material and are provided to protect the ends 37 of the support tube legs, and the floor beneath the bed. In addition, caps 35 add support and traction to manual support apparatus 10.

Figure 3:
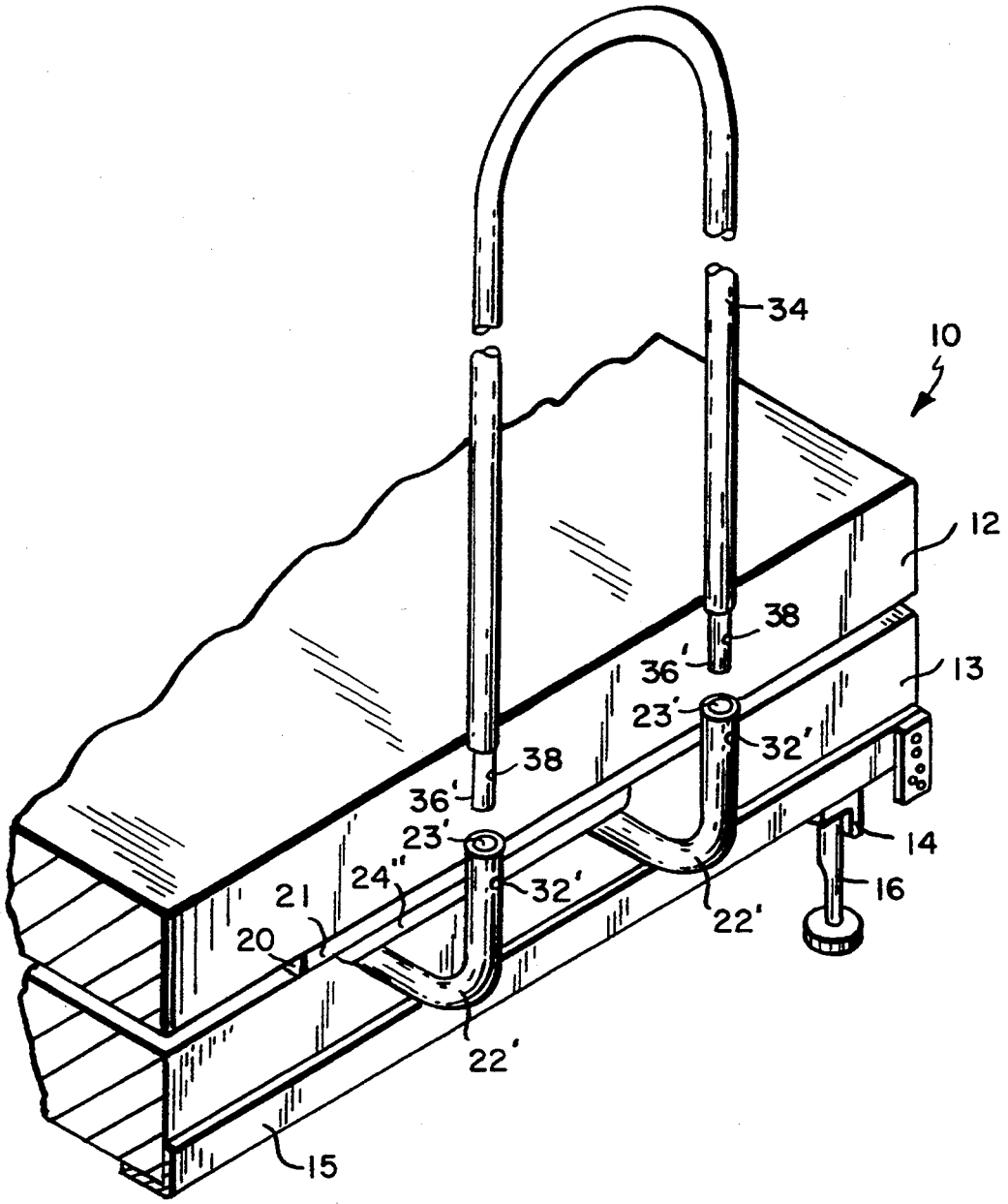
FIG. 3 is a perspective view of an alternative embodiment of the present invention.

FIG. 3 shows an alternative support tube 34 having a reduced cross-sectional diameter at legs 36' which fit into bores 23' of tubular members 22'. The legs 36' of support tube 34 include projections 38, which are similar to those shown in FIG. 1, and are spring-fit into, and can be pressed into, support tube legs 36' while the legs are placed into bores 23' of tubular members 22'. The projections 38 provide a locking mechanism as they are snap-fit into holes 32' when support tube legs 36' are placed into bores 23'. In addition, projections 38 provide an easy means to interchange various shapes and sizes of support tubes 34.

Tubular members 22' are attached to support brace 24'' similarly to tubular members 22 and support braces 24 and 24' in FIGS. 1 and 2. Preferably, tubular members 22' are welded to support brace 24''. Support brace 24'' also typically includes holes (not shown), which are aligned with holes in plate member 20 to allow fittings to pass through each and be mated to secure the brace to the planar plate. Tubular members 22' may also be attached directly to either the top or underside of planar plate 20. Furthermore, tubular member 22' may be shaped to extend horizontally only to outside edge 21 of planar plate 20. Accordingly, if this configuration of tubular members 22' is used, support tube 34 and legs 36' will be shaped such that legs 36' are turned horizontally to be inserted into tubular members 22' (until projections 38 are snap-fit into holes 32') while support tube 34 extends vertically (substantially perpendicular to mattress 12) upward.

Figure 4A:
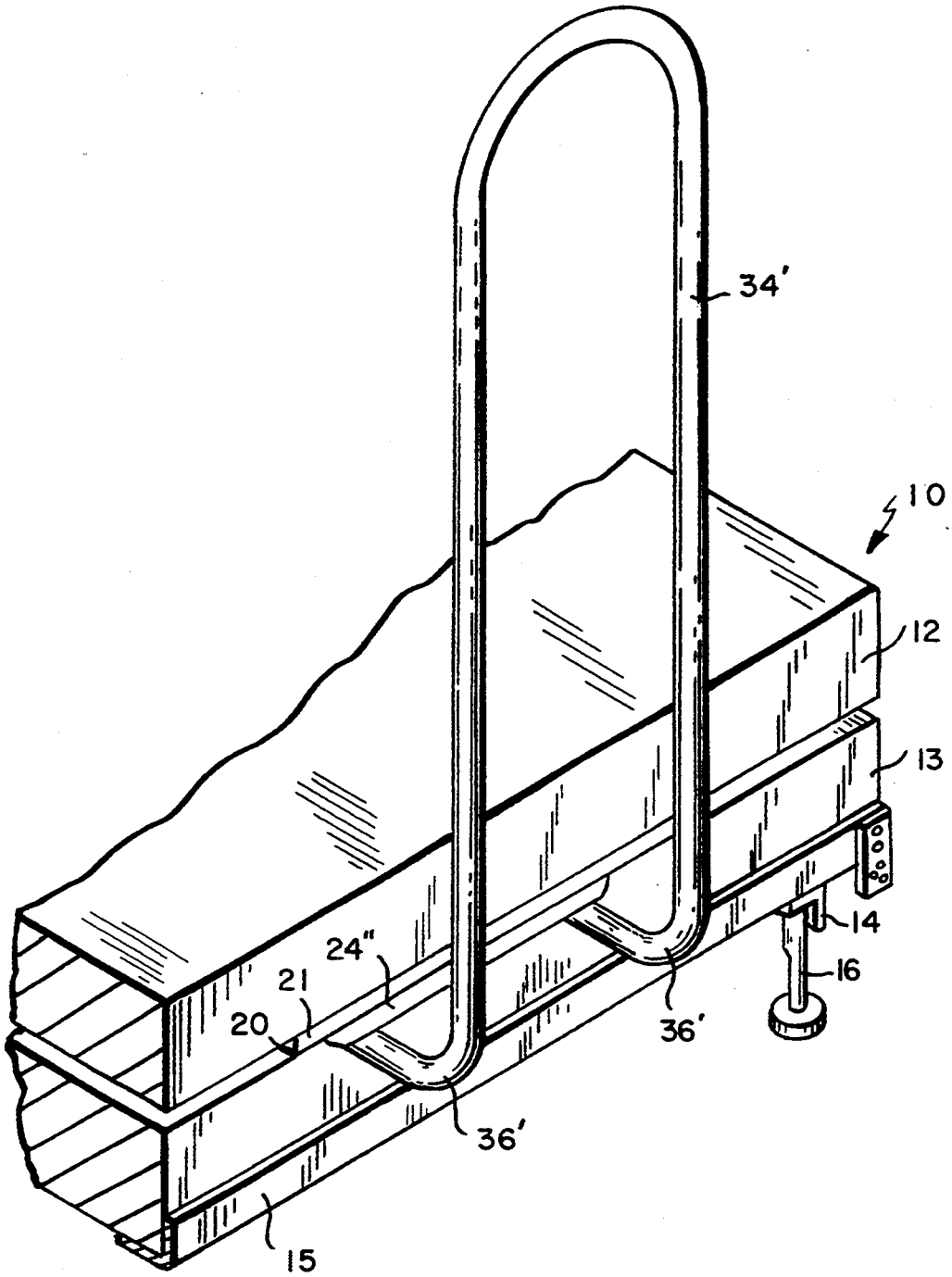
FIG. 4A is a perspective view of an alternative embodiment of the present invention shown in FIG. 3 wherein the support tube member can be attached directly to the planar plate member.
Figure 4B:
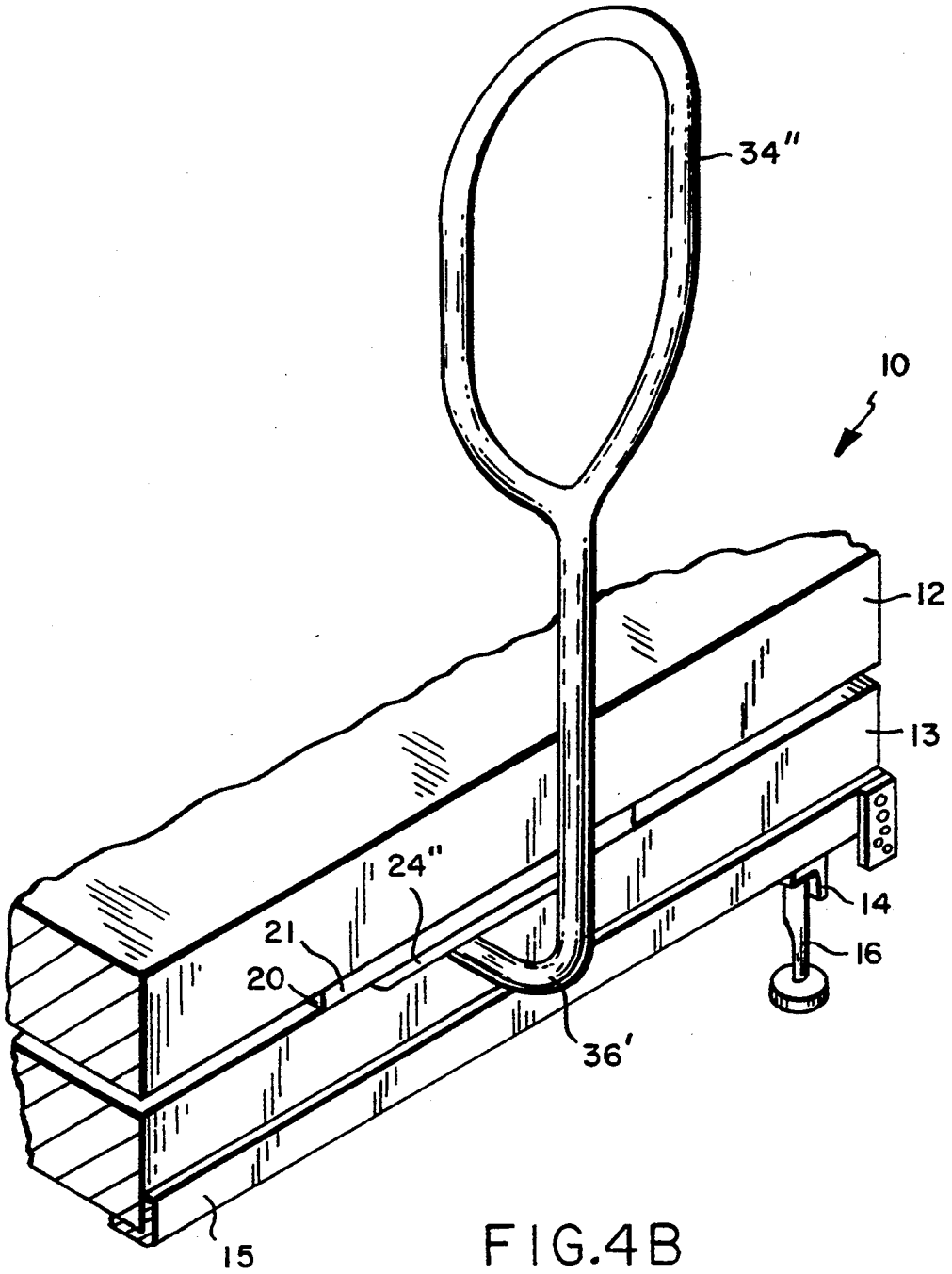
FIG. 4B is a perspective view of an alternative embodiment of the present invention shown in FIG. 4A.

FIGS. 4A and 4B illustrate an alternative embodiment of manual support apparatus 10. In this embodiment, the manual support apparatus 10 may be more easily assembled and installed on a bed. The manual support apparatus 10 comprises planar plate 20 having an outside edge 21, and a support tube 34' having at least one leg 36' which can be attached directly to support brace 24'', without tubular members. Typically, support tube leg 36' is welded to brace 24''. The brace 24'' is attached to planar plate 20 as noted above. Support tube 34′ is equivalent to incorporating the tubular members 22′ and support tube 34 of the embodiment shown in FIG. 3, and is preferred when the user/patient requires only one type of support tube.

FIG. 4B illustrates an alternative support tube 34″ design having one leg 36′ attached directly to support brace 24′, as described and shown in FIG. 4A. Although a loop-like handle design is shown on alternative support tube 34″ other designs can be provided with a single leg 36′.

Figure 5:
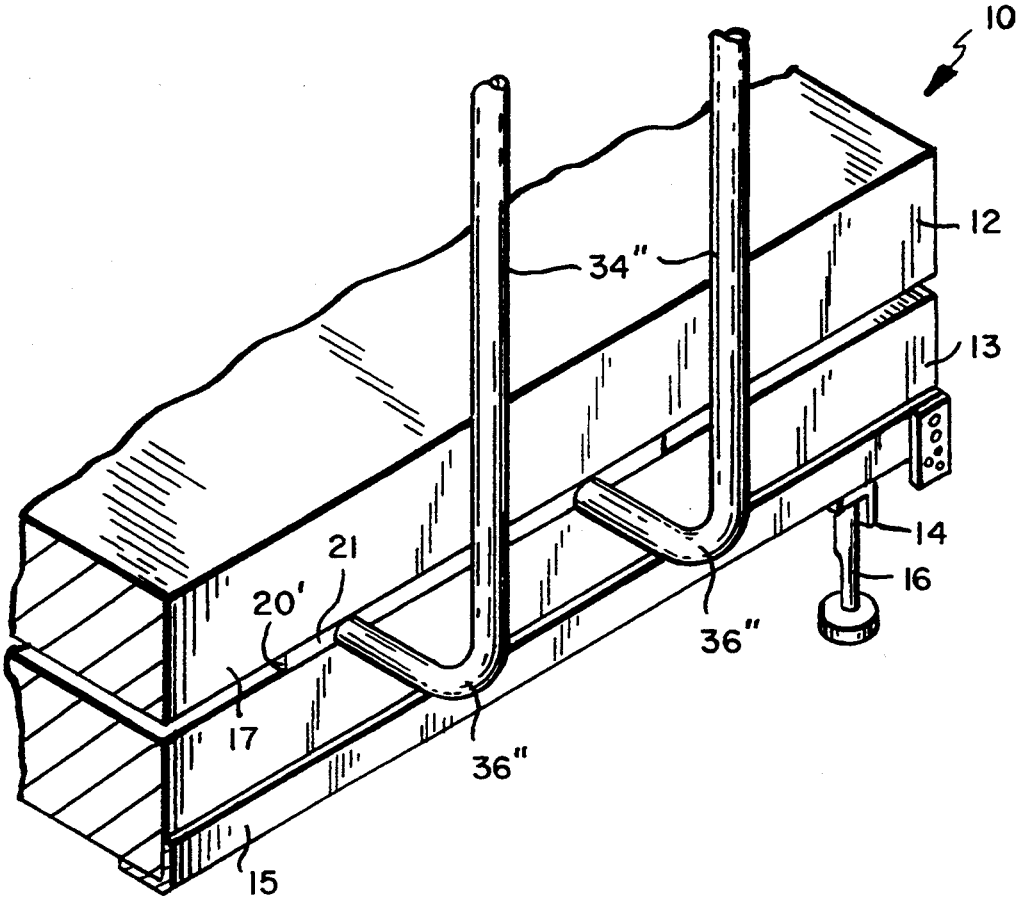
FIG. 5 is a perspective view of an alternative embodiment of the present invention which includes a unitary construction.

FIG. 5 illustrates another embodiment of manual support apparatus 10, which has a unitary construction and includes a planar plate portion 20′ having an outside edge 21, which aligns with a side 17 of mattress 12 and boxspring 13 of a bed, and a support tube portion 34″ having at least one leg 36″.

Although FIG. 5 shows support tube portion 34″ and legs 36″ projecting from edge 21, it is understood by those skilled in the art that other one piece configurations are possible. For example, manual support apparatus 10 can consist of only support tube 34″, configured such that it may be placed between a mattress 12 and boxspring 13 and protrude substantially perpendicularly from a side of the bed.

The present invention will be further illustrated by the following example, which is intended to be illustrative in nature and is not to be construed as limiting the scope of the invention.

EXAMPLE

One suitable construction of a manual support apparatus having a shape and design substantially in accordance with the present invention is provided by the following combination of elements.

A manual support apparatus, which can be installed on either a twin, full, queen, or king-sized bed having a mattress portion, is provided. The manual support apparatus includes a planar plate member made of ½ inch thick medium density fiberboard. The plate member is rectangular-shaped, having a width of 30 inches and a length of 48 inches. A powder-coated steel support tube is bent into an inverted U-shape. The support tube is formed of 18 gauge steel tubing having a ⅞ inch outside diameter. The support tube has two legs, including spring-fit projections. The support tube legs are fit into two steel tubular members, which are 3 inches long and have a 1 inch outside diameter. The tubular members include corresponding holes for the support tube legs' spring-fit projections. The tubular members are welded to two ¾ inch square tubes, which are 12 inches long. The square tubes are bolted to the plate member.

The foregoing detailed description has been given for clearness of understanding only, and unnecessary limitations are not to be construed therefrom. The invention is not to be limited to the exact details shown and described since obvious modifications will occur to those skilled in the art, and any departure from the description herein that conforms to the present invention is intended to be included within the scope of the claims.

What is claimed is:

1. A manual support apparatus for use with a bed having a mattress portion, comprising:
   - a planar plate member;
   - a support tube having at least one leg;
   - at least one detachable tubular member having an internal bore for slidable receipt of said support tube leg; and
   - detachable means to attach said tubular member to said plate member,
   - wherein said plate member is placed under said mattress portion such that said tubular member is adjacent and substantially perpendicular to said mattress portion.

2. The manual support apparatus of claim 1 wherein the planar plate member is a rigid material, said plate being relatively long and thin, in a manner providing that in installation it may be slipped under said mattress portion without significantly raising the mattress and long enough so as to be firmly held in place by the mattress portion without being easily dislodged.

3. The manual support apparatus of claim 1 wherein the support tube leg and the tubular member have complementary cross-sectional configurations such that the support tube leg is coaxially slidable through the bore of the tubular member.

4. The manual support apparatus of claim 1 wherein there are two tubular members having internal bores for slidable receipt of said support tube legs.

5. The manual support apparatus of claim 1 wherein said means to attach said tubular member to said plate member is part of said plate member.

6. The manual support apparatus of claim 1 wherein said means to attach said tubular member to said plate member is part of said tubular member.

* * * * *